United States Patent [19]

Berkhan

[11] 4,140,075

[45] Feb. 20, 1979

[54] STEERING CONTROL SYSTEM FOR SHIPS

[75] Inventor: Robert E. Berkhan, Cypress, Calif.

[73] Assignee: Paul-Munroe Hydraulies, Inc., Orange, Calif.

[21] Appl. No.: 814,025

[22] Filed: Jul. 8, 1977

[51] Int. Cl.[2] ..... B63H 25/22

[52] U.S. Cl. ..... 114/150; 137/595

[58] Field of Search ..... 114/144 R, 144 E, 150; 180/132, 139, 149, 152; 91/368; 137/595

[56] References Cited

U.S. PATENT DOCUMENTS

| | | | |
|---|---|---|---|
| 2,583,407 | 1/1952 | Binder | 91/368 |
| 2,784,703 | 3/1957 | Davis | 137/595 |
| 3,237,583 | 3/1966 | Johnson | 114/144 E |
| 3,468,126 | 9/1969 | Mercier | 114/150 |
| 3,758,235 | 9/1973 | Breeden | 417/222 |
| 3,799,096 | 3/1974 | Jeffery | 14/150 |
| 3,986,475 | 10/1976 | Heiser | 114/144 R |

*Primary Examiner*—Trygve M. Blix

*Assistant Examiner*—D. W. Keen

*Attorney, Agent, or Firm*—Harris, Kern, Wallen & Tinsley

[57] ABSTRACT

A steering control system for a ship including a hydraulic rudder actuator, a reversible variable displacement pump for powering the rudder actuator, a valve system for controlling the pump in responsive to certain input signals, and a helm system for generating command signals. The valve system includes two parallel fluid flow paths with at least oe relief valve in each flow path for generating a differential pressure to control the pump output. The valve system also includes a control valve with two movable members, one moving in response to rudder motion and the other moving in response to command signals, and controlling the relief valves in the flow paths. A permanent magnet electric motor receives command signals from a manual helm or an automatic pilot or otherwise, and drives one of the moving members of the control valve.

11 Claims, 4 Drawing Figures

STEERING CONTROL SYSTEM FOR SHIPS

BACKGROUND OF THE INVENTION

This invention relates to steering control systems for ships, typically oil tankers and other ocean going vessels, which require large forces for steering while at the same time providing precise control for minimum deviation from the set course.

The steering arrangements for large ships require large forces at the rudder post and the ability to control the forces from the remotely located ship's bridge. It has been conventional to utilize a large hydraulic actuator for moving the rudder, and a reversible variable displacement pump to drive the actuator, with a followup control system from the helm at the bridge to the pump. One conventional type of followup system commonly used has a large and expensive differential gearing mechanism and a relatively cumbersome arrangement for transmitting helm commands from the bridge to the rudder drive.

In an alternative approach attempted for the purpose of reducing the cost and complication of the steering arrangement, a three position directional valve has been utilized for controlling the rudder actuator. This type of system is sometimes referred to as a bang-bang system. Only a simple electrical connection is required from the helm to the rudder drive, but there are disadvantages to this configuration including lack of precision in determining rudder position, excessive shock loads, and low durability.

Another type of ship steering control, sometimes referred to as a hydromechanical control, is shown in U.S. Pat. Nos. 3,799,096 and 3,758,235, and in the paper Hydromechanical Differential for Ship Steering System by Robert H. Breeden delivered at the 30th National Conference on Fluid Power, Philadelphia, Pa. Nov. 12–14, 1974. The hydromechanical system does not have the disadvantages of the bang-bang system and eliminates the complicated differential gearing, however it does have other disadvantages.

Steering control systems for ships, while requiring large power output and precise control, should have a slow response time which calls for a low-rate of flow of fluid in the hydraulic controls. Precise control is more difficult to achieve with the low-rate-of-flow systems. This is a particular problem where fluid flow across a variable orifice is utilized as an error signal and non-linear pressure differentials develop. One mode of improving the operation of the hydromechanical system has been to increase the gain of the control system and thereby increase the response at low error signals. However instability sometimes results and is to be avoided.

Accordingly, it is an object of the present invention to provide a new and improved steering control system for a ship which can utilize the conventional power components and which converts the electric signals from this helm directly to a position error within the control component. A further object of the invention is to provide such a steering control system which avoids the differential gearing and bang-bang problems by utilizing hydraulic control and which avoids the problems of the prior art hydraulic systems by incorporating a new and improved control valve arrangement, which generates a differential control pressure by means of a cam. This arrangement allows the gain to be varied by shaping the cam lobe to provide a sensitive and stable system response under all conditions.

Other objects, advantages, features and results will more fully appear in the course of the following description.

SUMMARY OF THE INVENTION

The steering control system of the present invention may utilize a conventional rudder actuator and a conventional reversible variable displacement pump for powering the rudder actuator, with the pump being responsive to a differential pressure input. The invention incorporates control means for generating the differential pressure for controlling the pump, responding to command signals from the helm of the ship. The control means includes a first member movable at the command signal and a second member movable in a followup motion responsive to the rudder position. Relief valves are positioned in parallel flow paths, with the valves being operated in opposite directions by the relative motion of the two members to produce the differential pressure for pump control. The preferred embodiment utilizes a valve housing carrying the relief valves and rotatable about a common axis with a shaft, with the shaft carrying a cam for driving the relief valves. The valve housing is driven by the ship's rudder and the shaft is driven by a permanent magnet electric motor responding to the command signals.

DESCRIPTION OF THE PREFERRED EMBODIMENT

Figure 1:
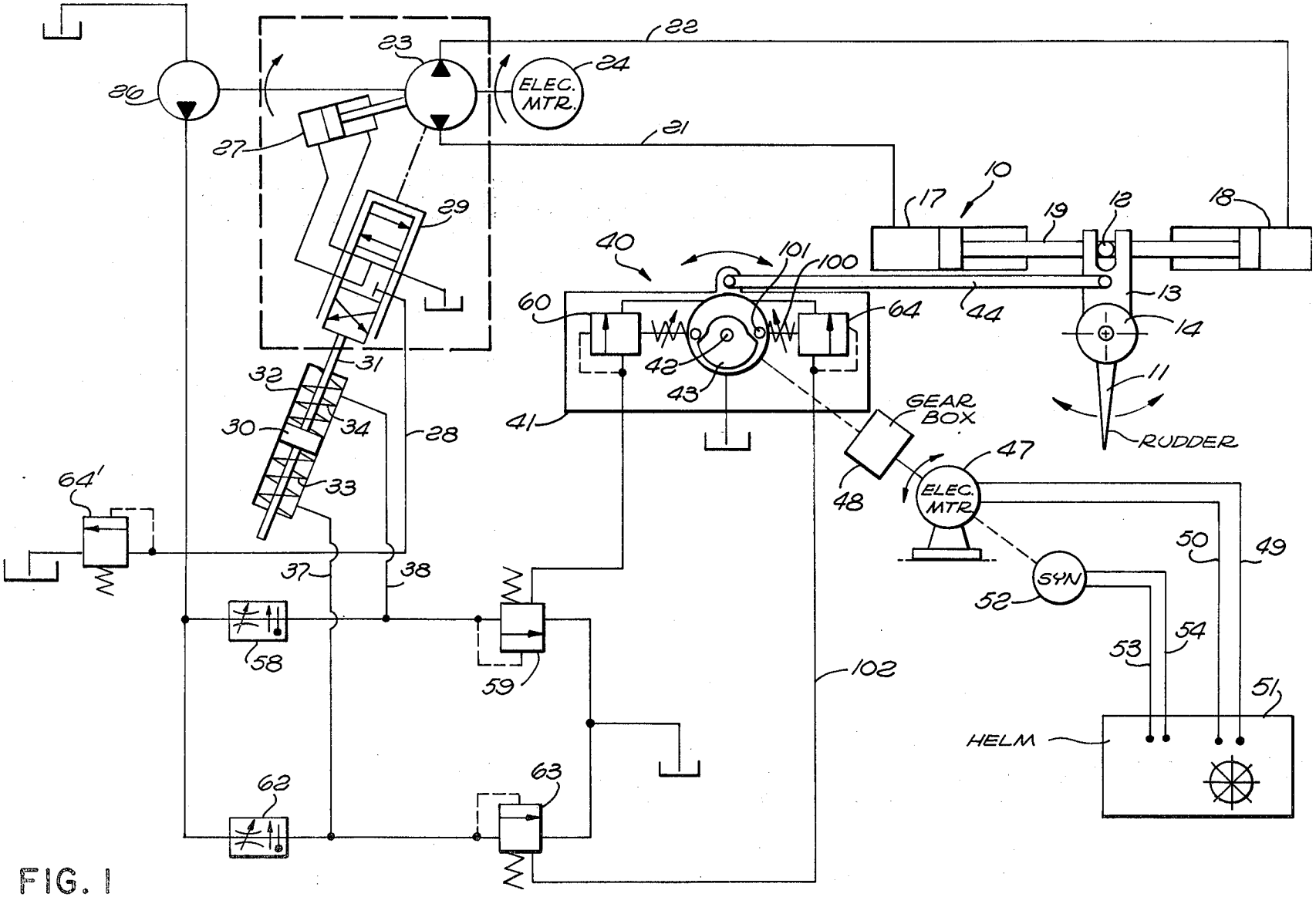
FIG. 1 is a schematic diagram of a ship steering control system incorporating the presently preferred embodiment of the invention.

Referring to FIG. 1, a rudder actuator 10 drives the rudder 11 by a pin 12 in a slot in the rudder pintle 13, with the pintle driving the rudder through the rudder post 14. The rudder actuator 10 may be any of those presently available and is illustrated as having cylinders 17, 18 with pistons connected by a shaft 19 carrying the pin 12. The cylinders 17, 18 are supplied through hydraulic lines 21, 22 from a reversible variable displacement hydraulic pump 23 which is driven by an electric motor 24. The pump and motor may be conventional units presently available. Various rotary type rudder actuators are available and may be used.

The motor 24 may also drive another pump 26 which provides fluid to the control system. The direction and the magnitude of the pump 23 is controlled by a hydraulic cylinder and piston 27 powered from hydraulic line 28 via a control valve 29. The spool of the valve 29 is coupled to a piston 30 by a shaft 31, with the piston sliding in a cylinder 32 and maintained in the centered off position by springs 33, 34. The piston 30 is moved by a differential pressure in lines 37, 38.

A control valve 40 has a body 41 and a shaft 42 with a cam 43 carried on the shaft. Both the body 41 and the shaft 42 rotate, and a preferred embodiment for this control valve will be described in conjunction with FIG. 2. The valve body 41 is coupled to the rudder pintle 13 by shaft 44, so that the valve body rotates with rotation of the rudder. The shaft 42 is driven by an electric motor 47 through a gear box 48.

The motor 47 is driven by signals on lines 49, 50 generated at the helm 51 of the ship. The electric signals for the motor may be produced by manual switching or by movement of the helm or by an automatic pilot. The electric motor also drives a synchronous transmitter 52 which provides a feedback signal to the helm on lines 53, 54. The helm signal generation and the feedback signal arrangement may be conventional.

The motor 47 preferably is a permanent magnet induction motor operated as a reversible ac synchronous motor. The motor typically may be a 110 volt two phase 60 hertz motor operating at 72 rpm. This type of motor provides a nearly instant start and stop operation, and can be stalled with full power without damage to the motor. As an alternative to this mode of operation, the motor may be operated as a dc stepper motor by a dc digital signal from the helm circuits.

The control system provides a first fluid flow path from the pump 26 through a flow regulator 58, a relief valve 59, and a pilot relief valve 60, to drain at 61, and a second flow path from the pump 26 through another flow regulator 62, a relief valve 63, and a pilot relief valve 64 to the drain 61. A pressure relief valve 64' may be provided in the line from the pump 26.

The valves 60, 64 are controlled by the relative motion of the valve body 41 and shaft 42. In the embodiment illustrated, the relief valves 60 and 64 are built into the body 41 of the control valve 40, providing a compact package for the control valve and associated components, with a minimum of couplings and interconnections.

Figure 2:
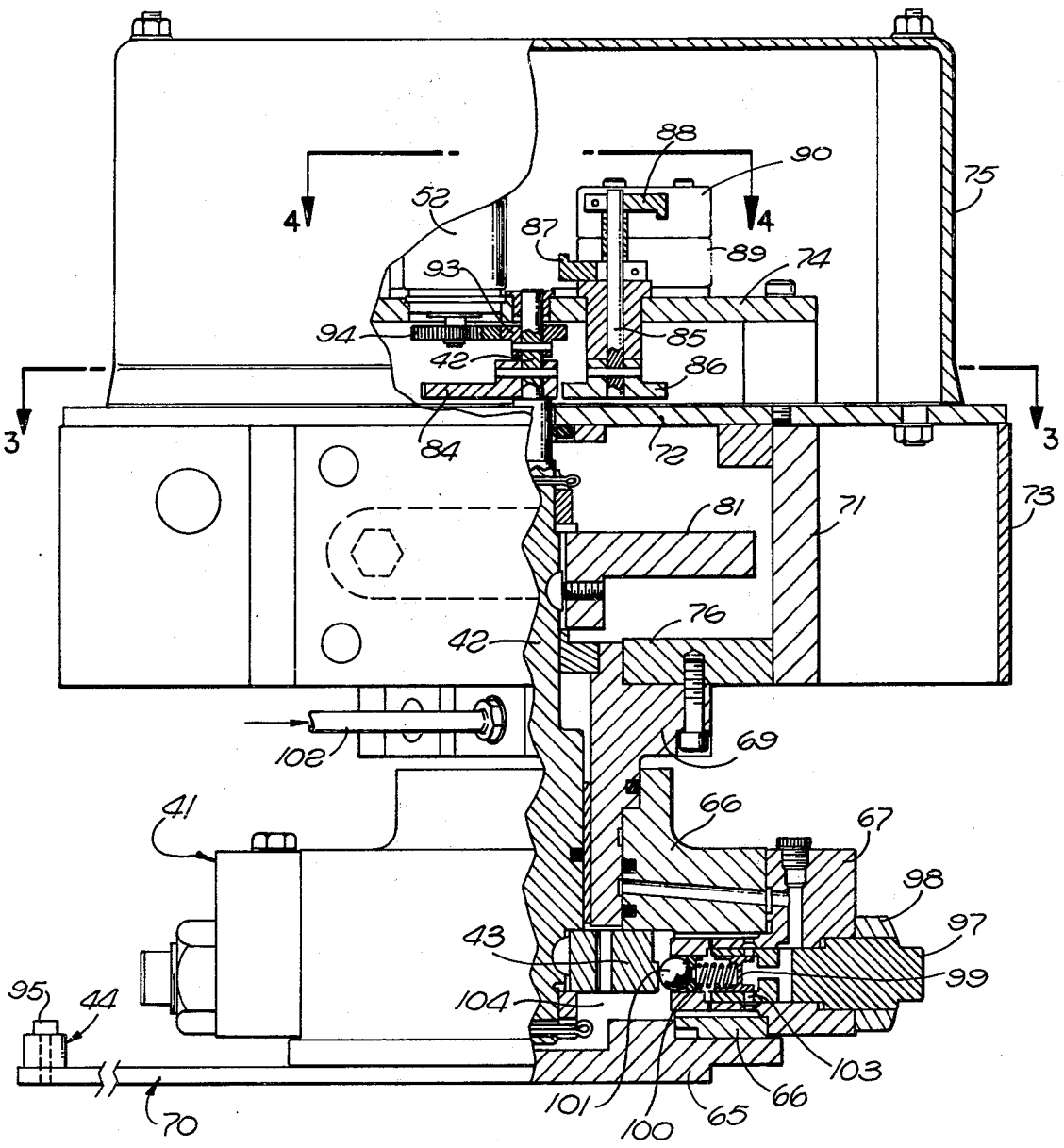
FIG. 2 is a vertical view, partly in section, illustrating the control valve of the system of FIG. 1.
Figure 3:
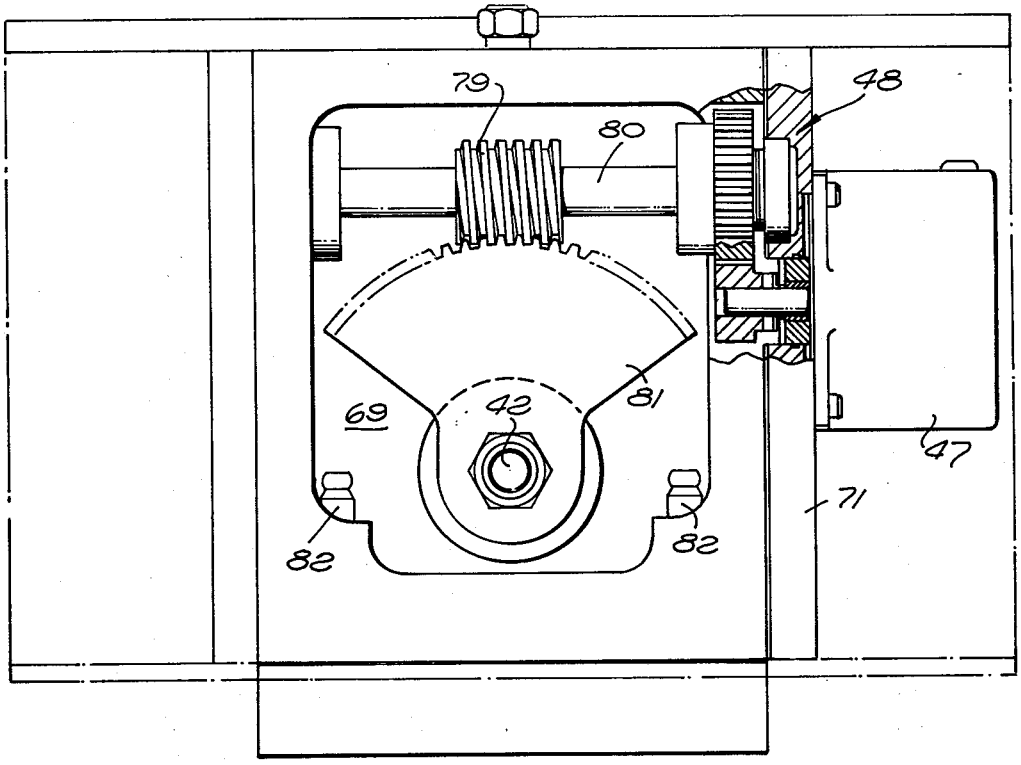
FIG. 3 is a sectional view taken along the line 3—3 of FIG. 2.
Figure 4:
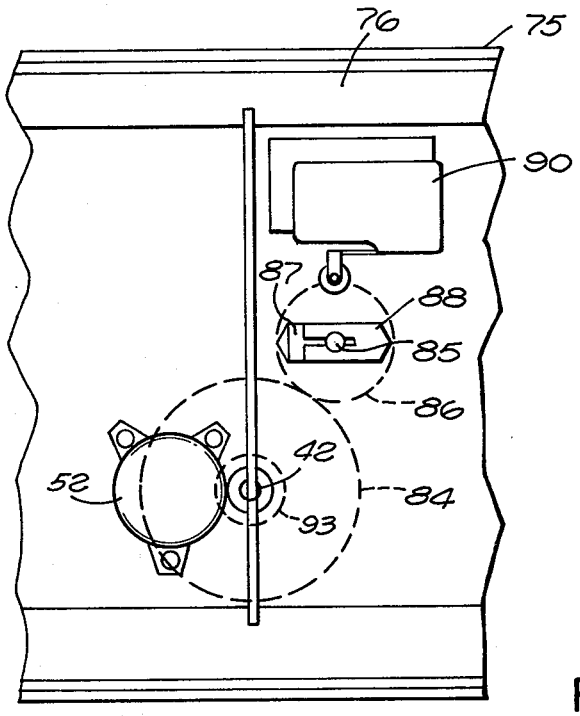
FIG. 4 is a partial sectional view taken along the line 4—4 of FIG. 2.

Turning now to FIGS. 2–4, the valve body or housing 41 rotates on a stator shaft 69, and the shaft 42 carrying the cam 43 rotates in the housing. The housing 41 includes elements 65–67. Elements 71–76 are connected to the stator shaft 69.

Referring to FIG. 3, the shaft 42 is driven by the motor 47 through the gear reduction 48, which a worm 79 on the shaft 80 driving a sector gear 81 on the shaft 42. Posts 82 are provided to act as mechanical stops for the shaft 42 and sector gear 81.

Referring to FIGS. 2 and 4, the upper extension of the shaft 42 carries a gear 84 which drives a shaft 85 through a gear 86. Cams 87, 88 are carried on the shaft 85 for actuating switches 89, 90, respectively, which may be utilized as limit switches. Another gear 93 on the shaft 42 drives the synchro transmitter 52 through gear 94.

The rod 44 which couples the rudder pintle to the valve housing is connected to the housing at the bar 70 by bolt 95.

The relief valves 60, 64 preferably are incorporated within the valve housing 41, and the preferred embodiment for the valve 64 is shown in FIG. 2. A plug 97 is threaded into a passage in the member 67 and is locked in place by a nut 98. A plunger 99 slides within a passage in the plug 97, with a spring 100 between the plunger and a ball 101, with the ball riding on the cam 43. Fluid from line 102 is directed through passages in the members 69, 66, 67, and a passage in the plug 97 to the right face of the plunger 99, tending to compress the spring and urge the ball into engagement with the cam. Rotation of the shaft 42 reducing the radius of the cam at the point of engagement with the ball permits movement of the plunger to the left, uncovering openings 103 in the plug 97, permitting fluid flow into the chamber 104 and thence to drain. The relief valve 60 is similarly constructed on the left of the cam.

The system is shown in the normal straight ahead no signal condition. When a rudder movement is commanded from the helm, the motor 47 is energized to rotate the shaft 42. This drives the cam 43 and the synchro 52 until the feedback signal from the synchro balances the command signal, at which time the motor rotation is stopped. Rotation of the cam 43 permits one of the relief valves 60, 64 to open more than the other, producing a differential pressure in the two flow paths. This produces a similar relative motion in the relief valves 59, 63 and provides the differential pressure on the lines 37, 38. The piston 30 is moved, moving the spool 29 and providing pressure to the control cylinder 27 to increase the displacement of pump 23 in the appropriate direction. This provides an input to the rudder actuator 10 and rotates the rudder. The rudder motion is coupled via the rod 44 to the valve housing 41, rotating the valve in the same direction that the cam 42 was rotated. When the housing has rotated through the same angle as the cam, the position of the valves 60, 64 is the same and there is no longer a differential pressure at the piston 30. Output from the pump 23 is turned off and the rudder is stopped in the commanded position. This rudder drive sequence occurs each time there is a command signal input to the motor 47, for rudder motion in either direction. It should be noted that the valves 59, 63, while preferable for increasing the magnitude of flow to cylinder 32, are not necessary to the operation of the system. While the relief valves 60, 64 are shown within the housing 41 of the control valve 40, it will be recognized that they can be mounted externally of the housing 41 and can be positioned separate from the housing and coupled to the housing if desired.

I claim:

1. In a steering control system for a ship having a rudder actuator, power unit for powering the rudder actuator in response to a differential pressure input, control means for generating a differential pressure for controlling the power unit, and means for generating command signals, the improvement wherein said control means includes in combination:

first and second relief valves each having a valve plunger;

means defining first and second parallel flow paths through said respective first and second relief valves from a source of fluid under pressure to a drain;

a control valve with a movable housing member and a movable shaft member, with said relief valves carried by one of said movable members and with said plungers differentially actuated by the other of said movable members;

means for connecting one of said movable members to the rudder;

means having the command signals as an input and connected to the other of said movable members, whereby relative motion of said control valve housing and shaft members produces a differential pressure at said relief valves; and means for connecting said first and second flow paths to said power unit in controlling relation.

2. A system as defined in claim 1 wherein said control valve housing member and shaft member are rotatable about a common axis.

3. A system as defined in claim 2 wherein said relief valves are mounted in said housing member, and said shaft member includes a cam for moving said relief valve plungers.

4. A system as defined in claim 3 wherein each of said relief valves includes a ball engaging said cam, and a spring between said ball and one face of said plunger, with the opposite face in the fluid flow path.

5. A system as defined in claim 1 including a third relief valve in said first flow path and controlled by said first relief valve, and a fourth relief valve in said second flow path and controlled by said second relief valve.

6. A system as defined in claim 5 wherein said means for connecting said first and second flow paths to said power unit includes a hydraulic cylinder with a piston therein defining first and second cylinder chambers, and means for centering said piston in said cylinder, with said first flow path connected to said first chamber and said second flow path connected to said second chamber.

7. A system as defined in claim 1 wherein said means having the command signals as an input includes an electric motor, with the motor output shaft coupled to said other movable member.

8. A system as defined in claim 7 wherein said electric motor is a permanent magnet inductor motor operated as an ac synchronous motor.

9. A system as defined in claim 7 wherein said electric motor is a permanent magnet motor operated as a dc stepper motor.

10. A system as defined in claim 1 wherein said control valve housing member and shaft member are rotatable about a common axis, with said relief valves mounted in said housing member and with said shaft member including a cam for moving said relief valve plungers, and wherein said means having the command signals as an input includes an electric motor with the motor output shaft driving said cam.

11. In a steering control system for a ship having a rudder actuator, power unit for powering the rudder actuator in response to a differential pressure input, control means for generating a differential pressure for controlling the power unit, and means for generating command signals, the improvement wherein said control means includes in combination:

first and second relief valves each having a valve plunger and a spring urging the plunger in one direction;

means defining first and second parallel flow paths through said respective first and second relief valves from a source of fluid under pressure to a drain;

a control valve with a movable housing member and a movable shaft member, with said relief valves carried by one of said movable members and with said plungers differentially actuated by the other of said movable members;

means for connecting one of said movable members to the rudder;

means having the command signals as an input and connected to the other of said movable members, whereby relative motion of said control valve housing and shaft members produces a differential pressure at said relief valves with the pressure differential being substantially linear with respect to the difference in movement of said movable members; and means for connecting said first and second flow paths to said power unit in controlling relation including a hydraulic cylinder with a piston therein defining first and second cylinder chambers, and means for centering said piston in said cylinder, with said first flow path connected to said first chamber and said second flow path connected to said second chamber.

* * * * *